US007727698B2

(12) United States Patent
Yoshida et al.

(10) Patent No.: US 7,727,698 B2
(45) Date of Patent: Jun. 1, 2010

(54) IMAGE FORMING METHOD

(75) Inventors: Eiichi Yoshida, Hino (JP); Masahiko Nakamura, Hachioji (JP); Masahiro Anno, Hachioji (JP); Kaori Soeda, Hino (JP); Tomoko Mine, Hino (JP); Kenichi Onaka, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 343 days.

(21) Appl. No.: 11/765,183

(22) Filed: Jun. 19, 2007

(65) Prior Publication Data

US 2007/0297822 A1 Dec. 27, 2007

(30) Foreign Application Priority Data

Jun. 22, 2006 (JP) ..... 2006-172267

(51) Int. Cl.
*G03G 15/08* (2006.01)

(52) U.S. Cl. ..... 430/123.5; 399/284

(58) Field of Classification Search ..... 430/111.4, 430/123.5; 399/279, 284
See application file for complete search history.

(56) References Cited

U.S. PATENT DOCUMENTS

2005/0163538 A1* 7/2005 Yamamura ..... 399/279
2005/0214032 A1* 9/2005 Koyanagi et al. ..... 399/279
2006/0068312 A1* 3/2006 Yamashita et al. ..... 430/109.4
2006/0210903 A1* 9/2006 Ohki et al. ..... 430/109.4

* cited by examiner

*Primary Examiner*—John L Goodrow
(74) *Attorney, Agent, or Firm*—Lucas & Mercanti, LLP

(57) ABSTRACT

Disclosed is an image forming method comprising developing a latent electrostatic image formed on the surface of a latent electrostatic image bearing body by a developer borne and conveyed by a developer bearing body which is brought into contact with a developer layer control member to control an amount of the developer on the surface of the developer bearing body through a nonmagnetic single-component development system, wherein an acid value (SAV) of the surface of the developer and a total acid value (TAV) of the developer meet the following requirements:

$1<SAV/TAV\leqq 5$ and $5\leqq TAV\leqq 25$, and a ratio of a mass average particle size (d50, μm) of the developer to a surface roughness (Ra, μm), d50/Ra being in a range of 0.5 to 3.0 and an average spacing (Sm) between protruding peaks of the developer bearing body being in a range of 20 to 200 μm.

7 Claims, 1 Drawing Sheet

IMAGE FORMING METHOD

TECHNICAL FIELD

The present invention relates to an image forming method to achieve development by a nonmagnetic single-component development system.

RELATED ART

There are known nonmagnetic single-component development systems, as described, for example, in JP-A Nos. 63-212946 and 63-271374 (hereinafter, the term JP-A refers to Japanese Patent Application Publication) and Japanese Patent No. 2774534. This system is provided with a developer bearing body, a toner layer control member and a toner-supplying auxiliary member, and a system wherein using a development apparatus in which the toner-supplying auxiliary member and the developer bearing body, and the member for controlling a toner layer and the developer bearing body are respectively in contact with each other, a thin layer of a nonmagnetic toner is supplied onto the surface of an electrostatic latent image forming body to form a latent image. In this system, the nonmagnetic toner is electrified through frictional electrification between the nonmagnetic toner and the developer bearing body or the member for controlling the toner layer.

It is therefore a technical point that nonmagnetic single-component development can stably electrify a toner even under environmental variation. A toner which exhibits a large environmental variation of electrification amount is, in general, excessively electrified under low temperature and low humidity and develops a non-imaging area, resulting in a fog image. On the other hand, the electrification amount decreases under high temperature and high humidity and transfer troubles occur, causing the lack of line images and resulting in lowering of solid image density.

To achieve stable electrification of a toner over environmental variation, it is necessary to achieve steady electrification at an electrifying site on the toner particle surface and maintain it. In a single-component development method, a thin toner layer is formed on the bearing body by passing it between the gap of the development bearing body and the toner layer control member which is disposed so as to be in contact with the developer bearing body and thereby toner particles are electrified. In that case, polar groups existing on the toner particle surface act as an electrification site. Accordingly, increase in the number of polar groups existing on the toner particle surface can bring about ensured electrification. However, such polar groups easily adsorb moisture in air, so that electrification cannot be held due to adsorbed moisture under high temperature and high humidity.

As a method to achieve stable electrification of a toner over environment variation is cited homogeneous dispersion of a pigment contained in the toner. Such homogeneous dispersion of a pigment can prevent leak of charge via the pigment. Introduction of polar groups into a binding resin is known as an effective means to achieve enhanced dispersion of a pigment in the toner. However, introduction of many polar groups results in a reduced electrification amount under high temperature and high humidity. A polar group content to obtain a favorable electrification amount is often incompatible with achieving enhanced dispersibility.

There is also known a technique in which an acid value of a resin contained in a yellow developer is noted and controlled to achieve enhanced color reproducibility (as disclosed in, for example, JP-A No. 11-52618; hereinafter, the term JP-A refers to Japanese Patent Application Publication) and a technique in which in the relationship of a toner and a developer bearing body, the ratio of weight average particle size of the toner to surface roughness of the developer bearing body is noted and the average spacing between protrusion peaks (average peak spacing) of the developer bearing body is further noted (as disclosed in, for example, JP-A No. 2000-228652).

A thin toner layer formed by passing it through the gap between a developer bearing body and a toner layer control member is conveyed and develops a latent electrostatic image formed on a latent electrostatic image bearing body. Herein, the developer bearing body has the function of electrifying a developer and conveying it. Accordingly, a developer bearing body exhibiting an excessively high surface roughness or excessively narrow average peak spacing (Sm) results in occurrence of electrification troubles due to over-conveyance of the toner, leading to toner fogging or transfer troubles on the photoreceptor. On the contrary, when a developer bearing body exhibits an excessively small surface roughness or an excessively broad average peak spacing (Sm), supply of a developer to the developer bearing body is poor and transfer troubles occur, resulting in formation of a solid image of uneven density.

SUMMARY

Accordingly, it is an object of the present invention to provide an image forming method to achieve formation of images of stable and high quality in a nonmagnetic single-component development system.

Aspects of the invention is as follows:

1. An image forming method comprising developing a latent electrostatic image formed on the surface of a latent electrostatic image bearing body by a developer borne and conveyed by a developer bearing body which is brought into contact with a developer layer control member to control an amount of the developer on the surface of the developer bearing body through a nonmagnetic single-component development system, wherein an acid value (denoted as SAV) of the surface of the developer and a total acid value (denoted as TAV) of the developer meet the following requirements:

$$1<SAV/TAV\leqq 5 \text{ and } 5\leqq TAV\leqq 25,$$

and a ratio of a mass average particle size (denoted as d50, expressed in μm) of the developer to a surface roughness (denoted as Ra, expressed in μm), d50/Ra being in the range of 0.5 to 3.0 and an average spacing (denoted as Sm) between protruding peaks of the developer bearing body being in the range of 20 to 200 μm.

2. The image forming method as described in 1, wherein the developer comprises a vinyl polymer resin.

3. The image forming method as 1 or 2, wherein the developer is formed by allowing a resin and a colorant to coagulate in aqueous medium.

According to the invention, there can be provided an image forming method to achieve formation of images of stable and high quality through a nonmagnetic single-component development system.

DETAILED DESCRIPTION OF THE INVENTION

Figure 1:
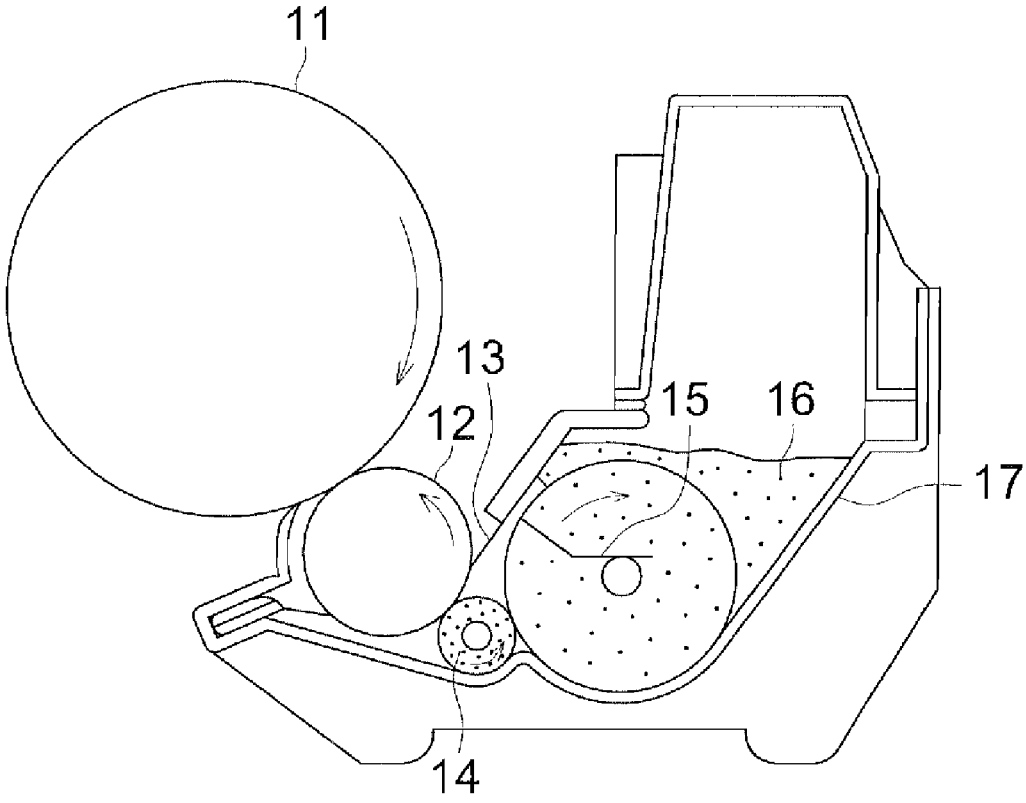
FIG. 1 illustrates a sectional view of a developing apparatus for use in the image forming method of the invention.

One feature of the invention is an image forming method comprising developing a latent electrostatic image formed on the surface of a latent electrostatic image bearing body by a developer bored and conveyed by a developer bearing body which is brought into contact with a developer layer control member to control the amount of the developer on the surface of the developer bearing body through a nonmagnetic single-component development system, wherein the acid value (SAV) of the surface of the developer and the total acid value (TAV) of the developer meet the following requirements:

$$1<SAV/TAV\leqq 5 \text{ and } 5\leqq TAV\leqq 25,$$

and the ratio of mass average particle size (d50, expressed in μm) of the developer to surface roughness (Ra, expressed in μm), d50/Ra is in the range of 0.5 to 3.0 and an average spacing between protruding peaks (Sm) of the developer bearing body is in the range of 20 to 200 μm.

The developer used in the invention refers to colored particles comprising a resin and a colorant, treated with external additives such as hydrophobic silica.

As a result of study by the inventors, it was found that the foregoing problem was overcome by enhancement of rising characteristics of a developer, that is, enhanced capability of electrifying the developer.

Raising the acid value of a developer is an effective means to make it easy to electrify the developer. However, raising acid value simply by copolymerization of a large amount of an acidic monomer tends to result in adsorption of moisture under high temperature and high humidity, often causing electrification leak and hindering electrification capability. Specifically, it was found that an acid value of the overall developer affected electrification leak and relation to the surface acid value was essential. Thus, it was found that an internal acid value affected moisture adsorption. The reason therefor is not clear but it is assumed that in addition to moisture adsorption, internal diffusion of charge was caused. It was found that the surface acid value greatly affected electrification capability so that an increase of an acid value on the surface was of importance.

Electrostatic properties were stabilized against environmental variations by controlling surface roughness of the developer bearing body and the thin developer layer on the surface of the developer bearing body was also stably obtained, whereby images of high quality were stably obtained.

It was found that when an acid (SAV) of the surface of a developer and a total acid value (TAV) of the developer meet $1<SAV/TAV\leqq 5$ and $5\leqq TAV\leqq 20$, superior dispersibility was achieved and stability of electrification amount was ensured. Further, $2.0\leqq SAV/TAV\leqq 3.5$ is preferred.

In the case of $5\leqq TAV\leqq 25$ and $SAV/TAV\leqq 1$, an acid value on the surface is low, resulting in lowered electrification capability and causing internal diffusion of a charge, and the developer cannot achieve sufficient electrification. In the case of $5\leqq TAV\leqq 25$ and $5<SAV/TAV$, an acid value on the surface is high, providing sufficient electrification capability but reduced internal diffusion of a charge inhibits leak of the charge, so that an electrification amount becomes excessive under low temperature and low humidity and even non-imaging areas are developed with the developer, leading to image defects such as fogging. $TAV<5$ results in insufficient dispersion of pigment and unstable electrification. $25<TAV$ increases moisture adsorption, rendering it difficult to hold electrification. A value falling within the range of $8\leqq TAV\leqq 18$ is preferred in terms of stable electrification. The SAV and TAV values can be controlled by the kind or amount of an acidic monomer or by mixing binding resins differing in acidic monomer composition, specifically, by controlling the structure of particles by using a monomer exhibiting an acid value. For example, there are used particles shelled with a resin exhibiting an acid value. Such particles, in which an acid value is controlled between the surface and the interior of the particle, are coagulated, thereby performing orientation of a resin exhibiting an acid value in an aqueous medium.

On the other hand, when the ratio of mass average particle size (d50, expressed in μm) of a developer to surface roughness (Ra) of the developer bearing body, that is, d50/Ra is in the range of 0.5 to 3.0 and an average peak spacing (Sm) of the developer bearing body is in the range of 20 to 200 μm, an optimum conveyance amount was achieved. A d50/Ra of less than 0.5 or a Sm of less than 20 μm causes electrification troubles due to excessive conveyance of a developer, resulting in toner fogging on the photoreceptor, while a d50/Ra of more than 3.0 or a Sm of more than 200 μm results in poor supply of developer to the developer bearing body and causes conveyance troubles, leading to lowering of image density. The Ra and Sm can be controlled by roughening the molding surface of a metal mold or by incorporating commonly known inorganic particles to the constituting member of the surface of the bearing body. A value of d50/Ra falls preferably within the range of 1.0 to 2.5, and that of Sm falls preferably within the range of 60 to 160 μm.

In the invention, the binding resin of the developer is preferably a vinyl polymer, while the developer is preferably one which is formed by coagulating resin particles in an aqueous medium.

In the invention, the acid value of the surface of a developer is an indication of the existing amount of a polymer or an oligomer obtained by copolymerization of an acidic monomer at a relatively large amount, existing in the vicinity of the developer surface. This acid value can be determined by using a solvent which does not dissolve copolymerizing constituents except for acidic monomers but dissolves a polymer or an oligomer formed mainly of an acidic monomer. The total acid value refers to the acid value which is determined by using a solvent capable of completely dissolving the developer.

The surface acid value (SAV) of a developer can be determined based on the testing method of an acid value defined in JIS K0070. Using, as a solvent, a mixture of diethyl ether and ethanol at a volume ratio of 1:1, the surface acid value can be determined by a potentiometric titration method. The total acid value (TAV) of a developer can also be determined based on the testing method of an acid value defined in JIS K0070, in which using a solvent mixture of diethyl ether and ethanol in a volume ratio of 1:1, the surface acid value can be determined by a potentiometric titration method by using a mixture of tetrahydrofuran and isopropyl alcohol at a volume ratio of 1:1, as a solvent.

In the invention, the mass average particle size (d50) means particle size corresponding to 50% of relative mass distribution versus particle size and is determined by Coulter Counter Multisizer MS-II (produced by Coulter Counter Co.). Measurement is not limited to this instrument but the value determined based on the measurement principle or method similar to the foregoing is also acceptable. In the invention, the mass average particle size is preferably from 2.0 to 10.0 μm and more preferably from 3.0 to 8.0 μm.

The surface roughness (Ra) and the average spacing between peaks (Sm) refer to a center-line mean roughness and an average spacing between protrusions (or peaks), respectively, as defined in JIS B 0601 and ISO 468. The Ra and Sm may be determined by any instrument which can measure values based on the definition described above. The surface of a developer bearing body, which is to be measured, is the surface in contact with the developer (thin-layer surface of a developer).

Specifically, the Ra, when the roughness curve is expressed by y=f(x), is a value, expressed in micrometer (μm), that is obtained from the following formula, extracting a part of reference length in the direction of its center-line from the roughness curve, and taking the center-line of this extracted part as the X-axis and the direction vertical magnification as the Y-axis:

$$Ra = \frac{1}{L}\int_0^L |f(x)|dx$$

wherein L is a reference length. In the invention, L is 2.5 mm and a cut-off value is 0.08 mm.

Measurement was conducted using a surface roughness measurement apparatus (Surfcorder SE-30H, produced by Kosaka Kenkyusho Co.) There is usable any apparatus giving rise to the same result falling within an error range.

Measurement Conditions of Surface Roughness:

Drive speed: 0.1 mm/sec

Stylus: 2 μm.

The Sm, when the roughness curve is expressed by y=f(x), is a value, expressed in micrometer (μm), that is obtained from the following formula, extracting a part of reference length (Ir) in the direction of its center-line from the roughness curve, and taking the center-line of this extracted part as the X-axis and the direction vertical magnification as the Y-axis:

$$Sm = (1/m)\sum_{i=1}^{m} Xsi$$

wherein Xs is an interval between lines crossing the X-axis from the positive side to the negative side.

Measurement was conducted using a surface roughness measurement apparatus (Surfcom 1400D, produced by Tokyo Seimitsu Co., Ltd.) There is usable any apparatus giving rise to the same result falling within an error range.

Measurement Conditions of Surface Roughness:

Measurement length (L): 4.0 mm

Reference length (Ir): 0.8 mm

Cut-off wavelength (λc): 0.8 mm

Needle top form: top angle of 60°, circular cone

Needle top diameter: 2 μm

Measurement speed: 0.3 mm/sec

Measurement magnification: 10.000-fold.

Measurement of each sample is performed with respect to 3 points at an equivalent interval in the axis direction and 3 points at an equivalent angle in the circumferential direction, totally 9 points and their average value is defined as an arithmetic average roughness Sm.

Ra is controllable by dispersing fine particles in a resin. As a resin constituting a developer bearing body is cited, for example, urethane resin. Particles providing roughness to control Ra are not specifically limited but ones which are capable of providing a function to control resistance are preferred. Specific examples thereof include carbon black and graphite. Particles having a number average primary particle size of 5 to 30 nm are preferred. An average thickness of a resin layer constituting the surface of a developer bearing body is preferably in the range of 5 to 30 nm.

Increased incorporation of fine particles results in increased roughness (Ra9 and reduced incorporation leads to increased Sm. An increase of particle size results in increased Ra, but not greatly affecting Sm itself. However, a larger particle size tends to result in enhanced dispersibility, so that Sm tends to become smaller.

Methods of dispersing particles are not specifically limited. For example, after a resin is dissolved in a solvent, fine particles are added thereto and dispersed by an ultrasonic homogenizer or a sand grinder.

Colored particles relating to the invention can be prepared by a suspension polymerization method or in such a manner that a monomer is subjected to emulsion polymerization in a liquid added with required additives to form fine polymer particles and then, an organic solvent, a flocculant coalescence and the like are added thereto to allow the particles to coalesce. There are cited, for example, a method in which a dispersion of a releasing agent, a coloring agent and the like, being necessary to constitute colored particles, is mixed with polymer particles, whereby the particles coalescence and a method in which constituents of colored particles, such as a releasing agent or a colorant are dispersed in a monomer and emulsion polymerization is performed. Coalescing refers to plural resin particles and colorant particles being fused.

The aqueous medium refers to one containing at least 50% by mass of water.

Thus, constituent materials of a colorant and optional additives, such as a releasing agent or a charge control agent and a polymerization initiator are added to a polymerizable monomer. Using a homogenizer, a sand mill, a sand grinder or an ultrasonic homogenizer, such constituents are dissolved or dispersed in the polymerizable monomer. Using a homomixer or a homogenizer, this polymerizable monomer, in which various constituents are dissolved or dispersed, is further dispersed in an aqueous medium in the form of oil droplets having a size desired as colored particles. The dispersion is then transferred to a reactor fitted with a stirring mechanism of stirring blades and heated to undergo polymerization reaction. After completion of the reaction, the dispersion stabilizer is removed and the reaction mixture is subjected to filtration and washing, and then dried to obtain the developer related to the invention.

As a method of preparing colored particles, related to the invention, is also cited a method of allowing resin particles to coalesce or fuse in an aqueous medium. This method is not specifically limited but examples thereof include methods described in JP-A Nos. 5-265252, 6-329947 and 9-15904.

Colored particles related to the invention can be formed through a method of allowing resin particles and particles of constituent materials such as a colorant, or plural particles constituted of resin, a colorant and the like to coalesce, specifically in the manner that these particles are dispersed in water using an emulsifying agent and then, a flocculent is added thereto at a concentration more than a critical coagulation concentration to cause salting-out with concurrently heating at a temperature higher than the glass transition temperature of the resin to fuse the particles to grow the particle size; when reaching an intended particle size, a large amount of water is added thereto to terminate the particle size growth; heating and stirring further continue to smoothen the particle surface to control the particle form and finally the particles are heated in a fluid state containing water and dried to obtain colored particles related to the invention. In this method, an organic solvent infinitely soluble in water may be added simultaneously with the flocculant.

Examples of a polymerizable monomer constituting a resin include styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene; methacrylic acid ester derivatives such as methyl methacrylate, ethyl methacrylate, n-butyl methacrylate, io-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; acrylic acid ester derivatives such as methyl acrylate, ethyl acrylate, iso-propyl acrylate, n-butyl v, t-butyl acrylate, iso-butyl acrylate, n-octyl acrylate, 2-ethylhexyl acrylate, stearyl acrylate, lauryl acrylate and phenyl acrylate; olefins such as ethylene, propylene and isobutylene; halogenated vinyls such as vinyl chloride, vinylidene chloride, vinyl bromide, vinyl fluoride and vinylidene fluoride; vinyl esters such as vinyl propionate, vinyl acetate and vinyl benzoate; vinyl ethers such as vinyl methyl ether and vinyl ethyl ether; vinyl ketones such as vinyl methyl ketone, vinyl ethyl ketone and vinyl hexyl ketone; N-vinyl compounds such as N-vinyl carbazole, N-vinyl indole and N-vinyl pyrrolidone; vinyl compounds such as vinylnaphthalene and vinylpyridine; acrylic acid or methacrylic acid derivatives such as acrylonitrile, methacrylonitrile and acrylamide. These vinyl monomers may be used alone or in combination.

The foregoing monomers need to be used in combination with acidic monomers. Such acidic monomers are those having, as a constituent group of the monomer, a substituent such as a carboxyl group, a sulfonic acid group or a phosphoric acid group. Specific examples thereof include acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamido-2-methylpropanesulfonic acid, acid phosphooxyethyl methacrylate, and 3-chloro-2-acid phosphooxypropyl methacrylate.

Further, a cross-linked resin can be obtained using polyfunctional vinyls such as divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

These polymerizable monomers can be polymerized using radical polymerization initiators. In that case, oil-soluble polymerization initiators are used in suspension polymerization. Specific examples of an oil-soluble polymerization initiator include azo- or diazo-type polymerization initiators such as 2,2'-azobis(2,4-dimethylvalelonitrile), 2,2'-azobisisobutylonitrile, 1,1'-azobis(cyclohexane-1-carbonitrile), 2,27-azobis-4-methoxy-2,4-dimethylvaleronitrile and azobisisobutyronitrile, peroxide polymerization initiators such as benzoyl peroxide, methyl ethyl ketone peroxide, diisopropylperoxycarbonate, cumenehydroperoxide, t-butylhydroperoxide, di-t-butyl peroxide, dicumyl peroxide, 2,4-dichlorobenzoyl peroxide, lauroyl peroxide2,2-bis(4,4-t-butylperoxycyclohexane)propane and tris(t-butylperoxy) triazine; polymeric initiators containing an oxide as a side chain.

In cases when employing emulsion polymerization, there are usable water-soluble radical polymerization initiators. Specific examples of a water-soluble radical polymerization initiator include persulfates such as potassium persulfate and ammonium persulfate; azobisaminodipropane acetic acid salt, azobiscyanovaleric acid and its salt, and hydrogen peroxide.

Examples of a dispersion stabilizer include tricalcium phosphate, magnesium phosphate, zinc phosphate, aluminum phosphate, calcium carbonate, calcium hydroxide, magnesium hydroxide, aluminum hydroxide, calcium metasilicate, calcium sulfate, barium sulfate, bentonite, silica, and alumina. Polyvinyl alcohol, gelatin, methyl cellulose and compounds which are generally used as a surfactant are also used as a dispersion stabilizer, such as sodium dodecylbenzenesulfonate, ethylene oxide adducts and higher alcohol sodium sulfate are also usable as a dispersion stabilizer.

Resins usable in the invention are preferably those exhibiting a glass transition temperature of 20 to 90° C. and also preferably those exhibiting a softening point of 80 to 220° C. The glass transition temperature can be determined by a differential calorimetry and the softening point can be determined by a flow tester. There are also preferred resins exhibiting a number average molecular weight (Mn) of 1000 to 100000 and a mass average molecular weight (Mw) of 2000 to 1000000, which are determined by gel permeation chromatography. Mw/Mn, as molecular weight is preferably 1.5 to 100, and more preferably 18 to 70.

Flocculants usable in the invention are not specifically limited but those chosen from metal salts are suitably used, including mono-valent metal salts, for example, salts of alkali metals such as sodium, potassium and lithium; di-valent metal salts, for example, salts of alkaline earth metals such as calcium and magnesium and di-valent metal salts such as manganese and copper; and tri-valent metal salts, such as iron and aluminum. Specific examples thereof include mono-valent metal salts such as sodium chloride, potassium chloride and lithium chloride; di-valent metal salts such as magnesium chloride, calcium chloride, calcium nitrate, zinc chloride, copper sulfate, magnesium sulfate and manganese sulfate; tri-valent metal salts such as aluminum chloride and iron chloride.

These flocculants are added at a concentration more than a critical coagulation concentration. The foregoing critical coagulation concentration is a measure relating to stability of dispersed material in an aqueous dispersion, indicating a concentration at which coagulation occurs when adding a flocculent. The critical coagulation concentration varies depending on the flocculant itself and the dispersing agent used therein, which are described, for example, in S. Okamura et al., "Kobunshi Kagaku" 17, 601 (1960) and therefrom, values can be found. Alternatively, a desired salt is added to a particle dispersing solution with varying the concentration to measure the ζ-electric potential of the particle dispersing solution and the salt concentration at which the ζ-electric potential starts to vary can be defined as the critical coagulation concentration. The concentration of a flocculent may be greater than the critical coagulation concentration, preferably by a factor of at least 1.2 and more preferably at least 1.5 times greater than the critical coagulation concentration.

An infinitely soluble solvent refers to a solvent which is infinitely soluble in water and in the invention, as this solvent is chosen one which does not dissolve the formed resin. Specific examples thereof include alcohols such as methanol, ethanol, propanol, isopropanol, t-butanol, methoxyethanol, and butoxyethanol; nitrites such as acetonitrile; and ethers such as dioxane. Of these, ethanol, propanol and isopropanol are preferred. An infinitely soluble solvent is added preferably in an amount of 1% to 100% of a polymer-containing dispersion having been added with a flocculent.

After preparation and filtration of colored particles, it is preferred to subject the colored particle in the form of a slurry containing at least 10% by mass of water to fluidized drying to enhance uniformity of particle form. In that case, the use of a polymer containing a polar group is preferred. The reason is supposed that existing water brings about a somewhat swelling effect, whereby enhanced uniformity of particle form is achieved.

Colored particles related to the invention contain at least a resin and a colorant and may optionally contain a releasing agent as a fixing-modifier and a charge control agent. Further, an external additive composed of inorganic or organic microparticles may be incorporated to colored particles having a resin and a colorant as main components.

Colorants used for the colored particles of the invention include carbon black, magnetic materials, dyes, and pigments. As carbon black are usable channel black, furnace black, acetylene black, thermal black and lamp black.

Examples of dyes include C.I. Solvent Red 1, the said 49, the said 52, the said 58, the said 63, the said 111, the said 122; C.I. Solvent Yellow 19, the said 44, the said 77, the said 79, the said 81, the said 82, the said 93, the said 98, the said 103, the said 104, the said 112, the said 162; and C.I. Solvent Blue 25, the said 36, the said 60, the said 70, the said 93 and the said 95. A mixture of the foregoing dyes is also usable. There may be employed, as pigments, C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, and the same 60, and mixtures thereof may be employed. The number average primary particle diameter varies widely depending on their types, but is preferably between about 10 and about 200 nm.

Addition of a coloring agent is conducted in such a manner that a coloring agent is added at the coagulation stage of adding a coagulant to polymer particles prepared by emulsion polymerization or a coloring agent is incorporated to a monomer, followed by polymerization of the monomer to form colored particles. Before adding the coloring agent to the monomer to perform polymerization, it is preferred to subject the coloring agent to a surface treatment using a coupling agent to prevent inhibition of radical polymerization.

There may be added a low molecular weight polypropylene (number average molecular weight: 1500-9000) or a low molecular weight polyethylene.

There are also usable commonly known charge control agents which are dispersible in water. Specific examples thereof include Nigrosins dyes, metal salts of naphthenic acid or higher fatty acids, alkoxylated amines, quaternary ammonium compounds, azo-metal complexes, and metal salts or metal complexed of salicylic acid. The foregoing charge control agent or fixing-modifier preferably exhibits a number average primary particle size of 10 to 500 nm.

In a suspension polymerization toner which is prepared by a process of dispersing or dissolving colored particle-constituting components such as a colorant in a polymerizable monomer, followed by polymerization to obtain colored particles, the shape of colored particles can be controlled by control of flow of a medium in a reaction vessel for use in polymerization. Thus, in the case of formation of a developer comprised mainly of colored particles exhibiting a shape factor of 1.2 or more, the flow of the medium in a reaction vessel is made turbulent and when oil droplets which exist in an aqueous medium in a state of suspension of polymerization in progress become soft particles as a result of polymerization, collision of particles promotes coalescence of the particles, resulting in particles in an irregular form. In the case of formation of spherical colored particles exhibiting a shape factor of less than 1.2, the flow of the medium in the reaction vessel is made laminar, whereby collision of particles can be avoided to form spherical particles. According to the foregoing manner, distribution of colored particle shape can be controlled within the targeted range of the invention.

There will be described a development device usable in the image forming method of the invention. The development device used in the invention is provided with a developer bearing body, a developer layer control member and an auxiliary member supply developer, in which the auxiliary member for developer supply and the developer bearing body, and the developer layer control member and the developer bearing body are respectively in contact with each other. Preferably, it is a system in which a thinned nonmagnetic developer layer formed in the device is supplied to the surface of a latent electrostatic image forming body to perform development of the latent image.

The developer layer control member has not only a function of uniformly coating a developer on a developer bearing body but also has a function of providing frictional electrification to the developer bearing body. The developer layer control member, in which an elastic material such as urethane rubber, a metal plate or the like is used, is brought into contact with the developer bearing body to form a thinned developer layer on the developer bearing body. The thinned layer refers to a layer formed by superposing a developer in layers of at most 10, and preferably not more than 5 in the development region. The developer layer control member is brought into contact with the developer bearing body preferably under a pressure of 0.1 to 5.0 N/cm, and more preferably 0.2 to 4.0 N/cm. A pressure of less than 0.1 N/cm results in nonuniform developer conveyance, tendering to cause conveyance unevenness and producing white streaks in the image. The developer bearing body preferably has a diameter of 10 to 50 mm.

An auxiliary member for developer supply is a unit to perform stable supply of developer to the developer bearing body. This auxiliary member can employ a water turbine roller provided with a stirring blade or a sponge roller. The auxiliary member preferably has a diameter of 0.2-1.5 times that of the developer bearing body. An excessively small diameter results in insufficient supply of the developer and an excessively large diameter results in excessive supply, and both cases lead to unstable supply of developer, tendering to cause image troubles of streaks.

The latent electrostatic image forming body is typically an electrophotographic photoreceptor. Specific examples thereof include an inorganic photoreceptor such as selenium or arsenic, an amorphous silicon photoreceptor and an organic photoreceptor. Of these, the organic photoreceptor is preferred and one having a layered structure of a charge transport layer and a charge generation layer is preferred.

FIG. 1 illustrates a sectional view of an example of a development device used in the image forming method of the invention.

In FIG. 1, a nonmagnetic single-component developer 16 enclosed in a developer tank 17 is forcedly conveyed and supplied onto a sponge roller 14 as an auxiliary member for developer supply by a stirring blade 15 also as an auxiliary member for developer supply. The developer supplied onto the sponge roller is conveyed onto a developer bearing body 12 through rotation of the roller 14 in the direction indicated by the arrow and electrostatically and physically adsorbed through friction with a developer bearing body 12 onto the surface thereof. The developer adhered onto the developer bearing body 12 uniformly forms a thin layer by rotation of the developer bearing body in the direction indicated by the arrow and a stainless steel elastic blade 13 and is frictionally electrified. Subsequently, the thin developer layer on the developer bearing body 12 is brought into contact with or is brought close to the surface of an electrophotographic photoreceptor drum 11 as a latent electrostatic image bearing body to develop a latent image.

Suitable fixing methods used in the invention include a so-called contact heat-fixing system. As such a contact heat fixing system are cited a heat pressure fixing system, a heat roller fixing system and a pressure contact heat fixing system which performs fixing by a pivotable pressure member incorporating a fixed heating body.

The heat roller fixing system is comprised of an upper roller which is formed of a metal cylinder of iron or aluminum, covered with tetrafluoroethylene, copolymer of tetrafluoroethylene and perfluoroalkoxyvinyl ether or the like and having a heat source in the interior thereof and a lower roller formed of silicone rubber or the like. A typical heat source contains a linear heater which heats the upper roller to a surface temperature of 120 to 200° C. In the fixing section, pressure is applied between the upper roller and the lower roller to deform the lower roller to form a so-called nip. The nip width is preferably from 1 to 10 mm, and more preferably 1.5 to 7 mm. The linear fixing speed is preferably from 40 to 600 mm/sec. An excessively narrow nip cannot provide uniform heat to the developer, resulting in fixing unevenness, while an excessively wide nip width accelerates fusion of the resin, resulting in excessive fixing off-set.

There may be provided a fix-cleaning mechanism. As this system is usable a system of supplying silicone oil to the upper fixing roller or film or a method of cleaning by use of a pad, roller or web impregnated with silicone oil.

There will be described a fixing system by use of a pivotable pressure member enclosing a fixed heating body.

This fixing system is a pressure-contact heat fixing system which is comprised of a fixed heating body and a pressure member having face-to-face contact with the heating body and allowing a recording material to be in contact with the heating body via film.

This pressure-contact heat fixing device is comprised of a heating section containing a heating bodies having a smaller heat capacity than a conventional heat roller and being linearly arranged in the passing direction of the recording material and also in the direction vertical thereto. The maximum temperature of the heating section is usually in the range of 100 to 300° C.

Pressure-contact heat fixing is a method of fixing with compressing an unfixed developer image against a heat source, for example, a system of passing a recording material having an unfixed developer between a heating body and a pressure member, as is usually often employed. Thereby, heating is promptly achieved, rendering high-speed fixing feasible. However, temperature control is difficult in this system and often causes so-called developer off-set, in which a developer remains on the portions being directly in contact with unfixed developer, such as surface portions of the heating source. There are also problems that troubles such as a recording material winding around the fixing device easily occur.

EXAMPLES

The embodiments of the invention are further described with reference to examples but the invention should not be construed to be limited to these.

Preparation of Colored Particle C1

(1) Preparation of Latex (1HML)

1) Preparation of Nucleus Particles (1st Polymerization Step: Formation of Latex 1H)

To a 5000 ml separable flask provided with a stirrer, a temperature sensor, condenser tube and nitrogen introducing device, 1.6 g of a compound of the foregoing formula (1) and a surfactant solution (aqueous medium) of 7.08 g of an anionic surfactant, sodium laurylsulfate dissolved in 3010 g deionized water were introduced and heated to 80° C. while stirring at a rate of 230 rpm in a stream of nitrogen.

To the surfactant solution, an initiator solution of 9.2 g of a polymerization initiator (potassium persulfate: KPS) dissolved in 200 g deionized water was added and raised to a temperature of 75° C. and then, a monomer mixture solution comprised of 77.8 g of styrene, 17.7 g of n-butyl acrylate and 2.52 g of acrylic acid was dropwise added over a period of 1 hr. The mixture was heated at 75° C. for 2 hr with stirring to undergo polymerization (1st polymerization step) to obtain a latex (dispersion of resin particles comprised of a high molecular weight resin). This was designated "latex (1H)".

2) Formation of Interlayer (2nd Polymerization Step: Preparation of Latex 1HM)

To a flask provided with a stirrer containing a monomer solution comprised of 104.1 g of styrene, 28.4 g of butyl acrylate, 3.49 g of acrylic acid and 5.6 g of n-octyl 3-mercaptopropionate, 98.0 g of crystalline material, represented as below was added and dissolved with heating at 90° C. to obtain a monomer solution 4.

compound A

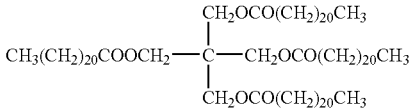

Further, 1.6 g of sodium laurylsulfate was dissolved in 1560 ml of deionized water and heated at 98° C. To this surfactant solution, a nucleus particle solution of the foregoing latex (1H) was added in amount of 28 g solids (i.e., represented by equivalent converted to solids), further thereto, the monomer solution of the exemplified compound (19) was added and dispersed for 8 hr. using a mechanical stirrer having a circulating path (CLEAR MIX, M Technique Co., Ltd.) to obtain a dispersion (emulsion) containing emulsion particles (oil droplets).

Then, to the dispersion (emulsion), 5.1 g of polymerization initiator (KPS) dissolved in 240 ml deionized water and 750 ml of deionized water were added and heated at 98° C. for 12 hr. with stirring to perform polymerization (2nd polymerization step) to obtain a latex (a dispersion of composite resin particles a structure in which the foregoing resin particles comprised of a high molecular weight resin were covered with an intermediate molecular weight resin). This was designated "latex (1HM)".

3) Formation of Outer Layer (3rd Polymerization Step: Preparation of Latex 1HML)

To the latex (1HX) obtained, a monomer mixture solution comprised of 298 g of styrene, 93.6 g of n-butyl acrylate, 10.3 g of acrylic acid and 10.4 g of n-octyl 3-mercaptopropionate, 42 g of an aqueous 10% hydrogen peroxide and 42 g of an aqueous 10% ascorbic acid solution were dropwise added at a temperature of 80° C. over a period of 1 hr. After completing addition, the solution was heated for 2 hr. with stirring to perform polymerization (3rd polymerization step) and cooled to 28° C. to obtain a latex. This was designated "latex (1HML)".

(2) Preparation of Colorant Dispersion

An anionic surfactant, sodium laurylsulfate of 59.0 g was dissolved in 1600 ml deionized water. To this solution, 400.0 g of C.I. Pigment Blue 15:3 was gradually added with stirring and then dispersed using a mechanical stirrer (CLEAR MIX, M Technique Co., Ltd.) until reached a dispersion particle diameter of 200 nm or less to obtain colorant dispersion 1.

(3) Preparation of Coalesced Particle (Coagulation/Fusion)

To a reaction vessel (four-bottled flask) provided with a temperature sensor, condenser, nitrogen introducing device and stirrer were added with stirring 200 g (solids content) of latex (1HML), 3000 g of deionized water and 33 g of colorant dispersion 1. After the internal temperature of the vessel was adjusted to 30° C., an aqueous solution of sodium hydroxide was added to the solution to adjust the pH to 8.0 to 11.0. Subsequently, 20 g of magnesium chloride hexahydrate dissolved in 20 ml deionized water was added at 30° C. over a period of 10 min. with stirring. After being allowed to stand for 3 min., heating was started and the temperature was raised to 75° C. over a period of 60 min.

While maintaining this state, the size of coalesced particles were measured using Coulter counter MS-II and when reached a mass-average particle of 6.5 μm, 29 g of sodium chloride dissolved in 60 ml deionized water was added to terminate the growth of the particles. Further, the reaction mixture was ripened at 90° C. for 6 hr. to continue fusion. Thereafter, the mixture was cooled to 30° C. and hydrochloric acid was added to adjust a pH to 2.0 and stirring was stopped. Particles which were thus formed through sating-out, coagulation and fusion, were filtered, repeatedly washed with deionized water at 45° C. and dried with hot air of 40° C. to obtain colored particles (denoted as colored particle C1).

Preparation of Colored Particle C2

(1) Preparation of Latex (2HML)

Similarly to the latex (1HM) obtained as above, a latex was obtained, provided that a monomer mixture of 306 g of styrene, 93.0 g of n-butylacrylate, 1.08 g of acrylic acid and 10.4 g of n-octyl 3-mercaptopropionate, 42 g of an aqueous 10% hydrogen peroxide solution and 42 g of an aqueous 10% ascorbic acid solution were added over 1 hr under a temperature condition of 80° C. After completion of addition, the reaction mixture was further stirred with heating over 2 hrs. to perform polymerization (3rd polymerization step) and then cooled to 28° C. The thus obtained latex was designated as "latex (2HML)".

(2) Preparation of Latex (3HML)

Similarly to the latex (1HM) obtained as above, a latex was obtained, provided that a monomer mixture of 295 g of styrene, 103.0 g of n-butylacrylate, 4.63 g of acrylic acid and 10.4 g of n-octyl 3-mercaptopropionate, 42 g of an aqueous 10% hydrogen peroxide solution and 42 g of an aqueous 10% ascorbic acid solution were added over 1 hr under a temperature condition of 80° C. After completion of addition, the reaction mixture was further stirred with heating over 2 hrs. to perform polymerization (3rd polymerization step) and then cooled to 28° C. to obtain a latex. The thus obtained latex was designated as "latex (3HML)".

(3) Preparation of Coalesced Particle (Coagulation/Fusion)

To a reaction vessel (four-bottled flask) provided with a temperature sensor, condenser, nitrogen introducing device and stirrer were added with stirring 100 g (solids content) of latex (2HML), 100 g (solids content) of latex (3HML), 3000 g of deionized water and 33 g of colorant dispersion 1. After the internal temperature of the vessel was adjusted to 30° C., an aqueous solution of sodium hydroxide was added to the solution to adjust the pH to 8.0 to 11.0. Subsequently, 20 g of magnesium chloride hexahydrate dissolved in 20 ml deionized water was added at 30° C. over a period of 10 min. with stirring. After being allowed to stand for 3 min., heating was started and the temperature was raised to 75° C. over a period of 60 min.

While maintaining this state, the size of coalesced particles were measured using Coulter Counter MS-II and when reached a number-average particle of 6-7 μm, 29 g of sodium chloride dissolved in 60 ml deionized water was added to terminate the growth of the particles. Further, the reaction mixture was ripened at 90° C. for 6 hr. to continue fusion. Thereafter, the mixture was cooled to 30° C. and hydrochloric acid was added to adjust a pH to 2.0 and stirring was stopped. Particles which were thus formed through sating-out, coagulation and fusion, were filtered, repeatedly washed with deionized water at 45° C. and dried with hot air of 40° C. to obtain colored particles (denoted as colored particle C2).

Preparation of Colored Particle C3

(1) Preparation of Latex (4HML)

Similarly to the latex (1HM) obtained as above, a latex was obtained, provided that a monomer mixture of 290 g of styrene, 99.0 g of n-butylacrylate, 12.3 g of methacrylic acid and 10.4 g of n-octyl 3-mercaptopropionate, 42 g of an aqueous 10% hydrogen peroxide solution and 42 g of an aqueous 10% ascorbic acid solution were added over 1 hr under a temperature condition of 80° C. After completion of addition, the reaction mixture was further stirred with heating over 2 hrs. to perform polymerization (3rd polymerization step) and then cooled to 28° C. The thus obtained latex was designated as "latex (4HML)".

Similarly to the preparation of colored particle C1, colored particle C3 was obtained, provided that latex (1HML) was replaced by latex (4HML). The mass-average particle size was 6.6 μm.

Preparation of Colored Particle C4

(1) Preparation of Latex (5HML)

Similarly to the latex (1HM) obtained as above, a latex was obtained, provided that a monomer mixture of 298 g of styrene, 94.0 g of n-butylacrylate, 0.31 g of methacrylic acid and 10.4 g of n-octyl 3-mercaptopropionate, 42 g of an aqueous 10% hydrogen peroxide solution and 42 g of an aqueous 10% ascorbic acid solution were added over 1 hr under a temperature condition of 80° C. After completion of addition, the reaction mixture was further stirred with heating to perform polymerization (3rd polymerization step) and then cooled to 28° C. The thus obtained latex was designated as "latex (5HML)".

(2) Preparation of Coalesced Particle (Coagulation/Fusion)

To a reaction vessel (four-bottled flask) provided with a temperature sensor, condenser, nitrogen introducing device and stirrer were added with stirring 100 g (solids content) of latex (5HML), 100 g (solids content) of latex (3HML), 3000 g of deionized water and 33 g of colorant dispersion 1. After the internal temperature of the vessel was adjusted to 30° C., an aqueous solution of sodium hydroxide was added to the solution to adjust the pH to 8.0 to 11.0. Subsequently, 20 g of magnesium chloride hexahydrate dissolved in 20 ml deionized water was added at 30° C. over a period of 10 min. with stirring. After being allowed to stand for 3 min., heating was started and the temperature was raised to 75° C. over a period of 60 min.

While maintaining this state, the size of coalesced particles were measured using Coulter counter MS-II and when reached a mass-average particle of 6.4 μm, 29 g of sodium citrate dissolved in 60 ml deionized water was added to terminate the growth of the particles. Further, the reaction mixture was ripened at 90° C. for 6 hr. to continue fusion. Thereafter, the mixture was cooled to 30° C. and hydrochloric acid was added to adjust a pH to 2.0 and stirring was stopped. Particles which were thus formed through sating-out, coagulation and fusion, were filtered, repeatedly washed with deionized water at 45° C. and dried with hot air of 40° C. to obtain colored particles (denoted as colored particle C4).

Preparation of Colored Particle C5

(1) Preparation of Latex (6HML)

Similarly to the latex (1HM) obtained as above, a latex was obtained, provided that a monomer mixture of 288 g of styrene, 94.0 g of n-butylacrylate, 18.1 g of acrylic acid and 10.4 g of n-octyl 3-mercaptopropionate, 42 g of an aqueous 10% hydrogen peroxide solution and 42 g of an aqueous 10% ascorbic acid solution were added over 1 hr under a temperature condition of 80° C. After completion of addition, the reaction mixture was further stirred with heating over 2 hrs. to perform polymerization (3rd polymerization step) and then cooled to 28° C. The thus obtained latex was designated as "latex (6HML)".

Similarly to the preparation of colored particle C1, colored particle C5 was obtained, provided that latex (1HML) was replaced by latex (6HML). The mass-average particle size thereof was 6.5 μm.

Preparation of Colored Particle C6

Similarly to the preparation of colored particle C1, colored particle C6 was obtained, provided that the mass-average particle size was adjusted to 3.5 μm.

Preparation of Colored Particle C7

Similarly to the preparation of colored particle C1, colored particle C7 was obtained, provided that the mass-average particle size was adjusted to 8.5 μm.

Preparation of Developers C1 to C7

Subsequently, to each of the foregoing colored particles C1 to C7 were added 1.0% by mass of hydrophobic silica (TG-811F, produced by Cabogil Co.), 1.5% by mass of strontium titanate particles and 1.0% by mass of NX90 (produced by Nippon Airosil Co.) and mixed by a Henschel mixer. Thereafter, the respective colored particles were sieved using a sieve with a aperture of 45 μm to remove coarse particles. Developers C1 to C7 were thus obtained.

Values of SAV/TAV, TAV and mass average particle size are shown below.

TABLE 1

| Developer | SAV/TAV | TAV | Mass Average Particle Size (μm) |
|---|---|---|---|
| C1 | 2.1 | 15.0 | 6.5 |
| C2 | 3.1 | 5.5 | 6.4 |
| C3 | 0.9 | 20.0 | 6.6 |
| C4 | 9 | 5.5 | 6.4 |
| C5 | 1.9 | 35.0 | 6.5 |
| C6 | 2.1 | 15.0 | 3.5 |
| C7 | 2.1 | 15.0 | 8.5 |

Preparation of Developer Bearing Body

A 30 μm thick high-resistant layer composed of urethane exhibiting a specific volume resistance of $7\times10^{10}$ Ω·cm was provided on the conductive substrate which was provided with a conductive layer composed of EDPM exhibiting a specific volume resistance of $10^5$ Ω·cm, around a stainless steel rotating shaft. The high-resistant layer was incorporated with fine particles having a numer-average primary particle size of 15 μm (fine graphite particles) and there were prepared developer bearing bodies differing in values of Ra and Sm by controlling an addition amount and dispersing conditions.

TABLE 2

| | Ra (μm) | Sm (μm) | Addition Amount | Dispersion Condition |
|---|---|---|---|---|
| R1 | 3.5 | 110 | 15% | medium-dispersion |
| R2 | 14.0 | 110 | 26% | medium-dispersion |
| R3 | 1.8 | 110 | 6% | medium-dispersion |
| R4 | 3.5 | 10 | 32% | high-dispersion |
| R5 | 3.5 | 210 | 15% | low-dispersion |
| R6 | 3.5 | 26 | 27% | high-dispersion |
| R7 | 3.5 | 186 | 11% | low-dispersion |

Evaluation

Combinations of a developer and a developer bearing body, as shown in Table 3 were evaluated using a full-color printer Magicolor 2300DL (produced by Konica Minolta Business Technologies Inc.).

After 10 sheets of a print pattern having a B/W ratio of 6% were printed using the above-described printer, a blank sheet pattern was printed, in which a developer remained on the development roller was sucked up and the electrification amount of the sucked developer was measured by an electrometer and its mass was also measured, whereby an electrification amount of the developer was determined. Measurement was conducted using a measurement instrument Model 210 HS-2A (produced by TREK Co.).

Environmental Stability of Electrification

After developers were each allowed to stand for 24 hrs. under low temperature and low humidity (10° C., 15% RH) or for 24 hrs. under high temperature and high humidity (30° C., 85% RH), the charge of the respective developers were measured and the difference of charge (ΔQ) between low temperature and low humidity, and high temperature and high humidity was determined. Environmental stability of electrification was evaluated based on the following criteria:

A: ΔQ of less than 20 μC/g and

C: ΔQ of not less than 20 μC/g.

Image Evaluation

Image Fogging

Evaluation was made with respect to fogging at the beginning time and at the time after completion of printing 4500 sheets of an image with a pixel ratio of 6% under an environment of 30° C. and 80% RH. A fogging density was represented by a relative value, based on the reflection density of paper being zero. Densitometry was carried out at ten points in the white background, using densitometer RD-918, produced by Macbeth Co. and its average value was determined. A fog density of 0.005 or less is acceptable in practice.

Lack of Text Image

After completion of continuous printing of 4500 sheets, printed images at the beginning and completion were visually observed and evaluated with respect to lack of text images, based on the following criteria, in which the deposition amount of a developer was 1.0 (±0.1) mg/cm$^2$ with controlling a bias:

A: no lack of text images was observed,

B: slight lack of text images was observed but acceptable in practice,

C: marked lack of text images was observed and unacceptable in practice.

TABLE 3

| Example No. | Developer | Developer Bearing Body | SAV/TAV | TAV | d50/Ra | Sm (μm) | Electrification Stability (μC/g) | Image Fogging Beginning | Image Fogging After 4500 sheets | Lack of Text Image |
|---|---|---|---|---|---|---|---|---|---|---|
| 1 | C1 | R1 | 2.1 | 15.0 | 1.86 | 110 | A (10) | 0.001 | 0.002 | A |
| 2 | C2 | R1 | 3.1 | 5.5 | 1.83 | 110 | A (8) | 0.001 | 0.002 | A |
| 3 | C6 | R1 | 2.1 | 15.0 | 1.00 | 110 | A (17) | 0.001 | 0.002 | A |
| 4 | C7 | R1 | 2.1 | 15.0 | 2.43 | 110 | A (7) | 0.001 | 0.003 | A |
| 5 | C7 | R2 | 2.1 | 15.0 | 0.61 | 110 | A (10) | 0.001 | 0.002 | A |
| 6 | C6 | R3 | 2.1 | 15.0 | 1.94 | 110 | A (9) | 0.001 | 0.003 | A |
| 7 | C1 | R6 | 2.1 | 15.0 | 1.86 | 26 | A (19) | 0.001 | 0.002 | A |
| 8 | C1 | R7 | 2.1 | 15.0 | 1.86 | 186 | A (16) | 0.001 | 0.002 | A |
| Comp. 1 | C3 | R1 | 0.9 | 20.0 | 1.89 | 110 | C (21) | 0.001 | 0.006 | C |
| Comp. 2 | C4 | R1 | 9.0 | 5.5 | 1.83 | 110 | C (25) | 0.001 | 0.009 | C |
| Comp. 3 | C5 | R1 | 1.9 | 35.0 | 1.86 | 110 | C (30) | 0.001 | 0.009 | C |
| Comp. 4 | C1 | R2 | 2.1 | 15.0 | 0.46 | 110 | A (18) | 0.001 | 0.009 | C |
| Comp. 5 | C1 | R3 | 2.1 | 15.0 | 3.61 | 110 | A (19) | 0.001 | 0.007 | C |
| Comp. 6 | C1 | R4 | 2.1 | 15.0 | 1.86 | 10 | C (25) | 0.001 | 0.009 | C |
| Comp. 7 | C1 | R5 | 2.1 | 15.0 | 1.86 | 210 | A (17) | 0.001 | 0.007 | C |

As apparent from Table 3, it was proved that Examples 1 and 2 according to the invention exhibited superior results in all evaluation items. It was further proved that comparative Example 1-7, some of which were superior in environmental stability of electrification, were inferior as images.

What is claimed is:

1. An image forming method comprising developing a latent electrostatic image formed on the surface of a latent electrostatic image bearing body by a developer borne and conveyed by a developer bearing body which is brought into contact with a developer layer control member to control an amount of the developer on the surface of the developer bearing body through a nonmagnetic single-component development system, wherein an acid value (SAV) of the surface of the developer and a total acid value (TAV) of the developer meet the following requirements:

$$1<SAV/TAV\leqq 5 \text{ and } 5\leqq TAV\leqq 25,$$

and a ratio of a mass average particle size (d50, μm) of the developer to a surface roughness (Ra, μm), d50/Ra being in a range of 0.5 to 3.0 and an average spacing (Sm) between protruding peaks of the developer bearing body being in a range of 20 to 200 μm.

2. The image forming method as claimed in claim 1, wherein the developer comprises a vinyl polymer resin.

3. The image forming method as claimed in claim 1, wherein the developer is formed by allowing a resin and a colorant to coagulate in aqueous medium.

4. The image forming method as claimed in claim 1, wherein said d50/Ra is in a range of 1.0 to 2.5.

5. The image forming method as claimed in claim 1, wherein said Sm is in a range of 60 to 160 μm.

6. The image forming method as claimed in claim 1, wherein said SAV/TAV is in range of 2.0 to 3.5.

7. The image forming method as claimed in claim 1, wherein said TAV is in a range of 8 to 18.

* * * * *